United States Patent [19]

Aughey

[11] 4,258,498

[45] Mar. 31, 1981

[54] NOISE PRODUCING TOY

[76] Inventor: John L. Aughey, 134 W. Second St., Hobart, Ind. 46342

[21] Appl. No.: 86,154

[22] Filed: Oct. 18, 1979

[51] Int. Cl.[3] ..... A63H 5/00

[52] U.S. Cl. ..... 46/178; 46/1 R; 124/64

[58] Field of Search ..... 46/194, 178, 174, 175 R, 46/195, 44, 11, 1 R, 1 E; 124/64, 63, 55, 56

[56] References Cited

U.S. PATENT DOCUMENTS

| | | | |
|---|---|---|---|
| 1,033,094 | 7/1912 | Fuda | 124/64 |
| 1,233,445 | 7/1917 | Camp et al. | 46/196 |
| 1,260,013 | 3/1918 | Neats | 46/44 UX |
| 2,665,676 | 1/1954 | Mobley, Jr. | 124/64 |
| 3,087,481 | 4/1963 | Foster | 46/175 R X |

FOREIGN PATENT DOCUMENTS

| | | | |
|---|---|---|---|
| 17845 | 8/1896 | United Kingdom | 46/194 |

*Primary Examiner*—Gene Mancene
*Assistant Examiner*—Mickey Yu
*Attorney, Agent, or Firm*—Hill, Van Santen, Steadman, Chiara & Simpson

[57] ABSTRACT

A pneumatic noise-producing toy utilizing a hollow cylindrical container having an elongated deformable tubular body member, closed at one end and provided with a removable closure member at the other end, and a firing device cooperable therewith having spaced jaw members between which the container may be disposed, and upon the application of manual force to move the jaw members toward one another sufficient compression forces may be applied to the container to deform the latter and increase the air pressure therein sufficient to forceably disengage the closure member therefrom and produce an explosion-like noise.

10 Claims, 7 Drawing Figures

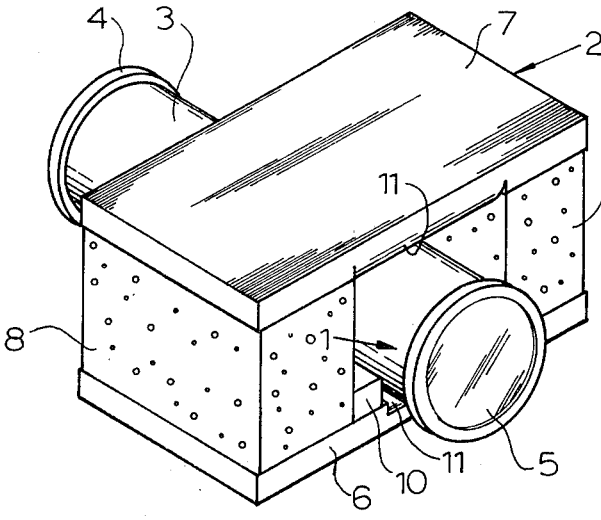
FIG 1
FIG. 2
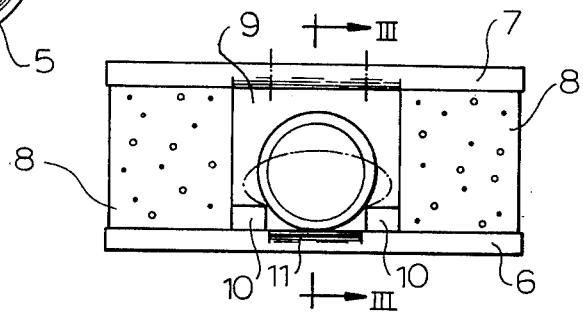
FIG. 3
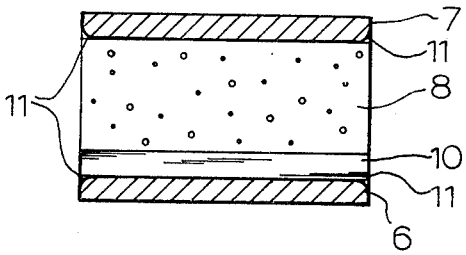
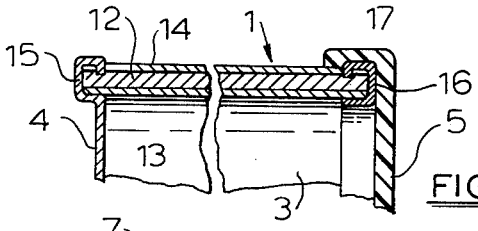
FIG. 4
FIG. 5
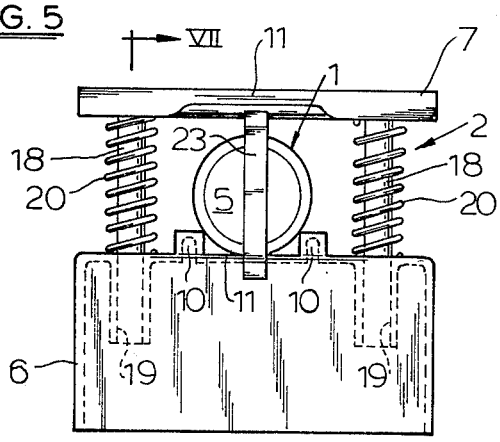
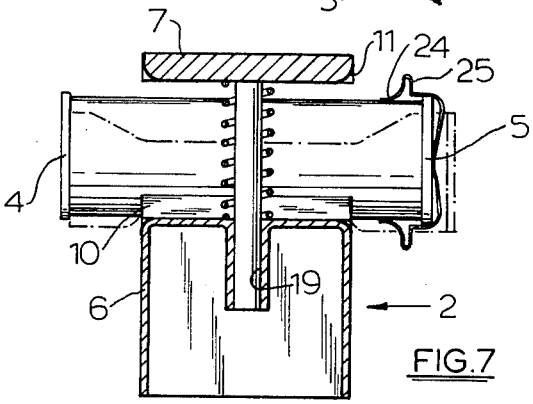
FIG.7
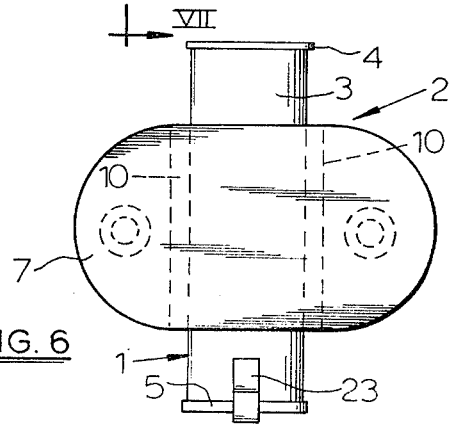
FIG. 6

NOISE PRODUCING TOY

BACKGROUND OF THE INVENTION

The invention is directed generally to a noise producing toy and more particularly to one utilizing air pressure for the production of the noise.

Noise producing toys have been on the market for many years including toys employing air pressure for the production of the noise. A toy of this type familiar to all is the so-called pop gun which usually simulates a rifle, having a barrel and stock, with a piston disposed in the barrel, usually biased in a forward direction toward the muzzle by a fairly heavy compression spring. Suitable cocking means, usually in the form of a lever action, is provided for moving the piston to a cocked position in which the spring is fully compressed, with the piston being retained in position by a trigger mechanism. The end of the barrel is closed by means of a suitable cork or the like which is firmly pressed into the barrel and upon actuation of the trigger the piston is released, whereby the spring rapidly moves the piston toward the muzzle end of the barrel, compressing the air therein to a pressure sufficient to force the cork out of the muzzle end of the barrel, creating an explosive-like pop or bang. Often times the cork is connected to the gun structure by a string of suitable length that will not impede the discharge of the cork but will prevent the cork from being lost.

Other types of noise producing toys include cap guns, carbide cannon paper punching guns, etc. Some of these such as cap guns involving explosive materials present danger factors and have resulted in injuries.

Likewise, pop guns and paper punching guns require various types of mechanisms as well as mechanical structures for controlling the operation thereof, as illustrated in various pop guns mechanisms and paper punching guns, etc.

SUMMARY OF THE INVENTION

The invention is directed to a noise producing toy employing only two major components, first an elongated generally cylindrically shaped tubular container or canister having a detachable closure member at one end, and second, suitable firing means for producing a deformation in the central portion of the tubular body of the canister by means of which a compression of air within the canister is effected, such increase in air pressure ultimately being sufficient to force the closure member off of the container to produce an explosive-like noise. The firing device is so proportioned that the deformation of the canister takes place at the central or intermediate portion thereof, whereby the ends of the canister are not deformed or otherwise damaged by the deformation or compression of the central portion of the tubular body. As a result, following a "firing" of the device, the canister body may be straightened out or returned substantially to its original configuration, the closure member replaced upon the open end of the canister, and the latter inserted in the firing structure for a further firing operation. Repetition of these operations renders the canister body more pliable and more easy to use in the manner explained.

The firing mechanism of the device permits a controlled application of manual force to the empty sealed canister resulting in a relatively sharp compression of the confined air therewithin without danger to the person actuating same such as a relatively small child, both in the operation of the device as well as from the resulting expelling of the closure member from the body.

The firing mechanism may be very simply fabricated in the form of two spaced jaw members adapted to receive the central portion of the canister therebetween, whereby upon the production of compression forces on the two jaw members the portion of the canister therebetween is compressed. The jaw members are so proportioned that such compressive action on the canister takes place only in the central portion thereof and does not extend to the ends of the canister, whereby the latter are undeformed. In accordance with the invention, guide means is provided for maintaining the jaw members in cooperable clamping relation as they are brought together, and preferably means is also provided for normally biasing the jaw members in a spaced relationship to permit ready insertion of the canister therebetween and for suitably aligning the inserted canister relative to the firing device.

Also, means may be provided for suitably connecting the closure member to the canister to prevent loss of the closure member as well as to control the movement thereof following disengagement from the canister.

BRIEF DESCRIPTION OF THE DRAWINGS

In the drawings, wherein like reference characters indicate like or corresponding parts:

FIG. 1 is a perspective view of one embodiment of the invention with the components thereof in operative positions for firing the same;

FIG. 2 is a front elevational view of the structure illustrated in FIG. 1;

FIG. 3 is a sectional view taken approximately on the line III—III of FIG. 1;

FIG. 4 is a longitudinal sectional view through opposite end portions of the canister;

FIG. 5 is a front elevational view of a modified construction;

FIG. 6 is a top plan view of the structure illustrated in FIG. 5;

FIG. 7 is a sectional view taken approximately on the line VII—VII of FIG. 5.

DETAILED DESCRIPTION OF THE INVENTION

Referring to the drawing and more particular to FIGS. 1–4 thereof, the reference numeral 1 indicates generally a container or canister adapted to be received in a firing device indicated generally by the reference numeral 2. The canister 1 comprises a hollow cylindrical body 3 of a deformable material which is closed at one end by a suitable closure member 4 and at the other end by a detachable closure member 5. The firing mechanism 2 in the embodiment illustrated comprises two rigid, generally rectangular shape jaw members 6 and 7 which as illustrated in FIGS. 2 and 3 are disposed in spaced parallel relation with the distance between these two members being greater than the diameter of the canister 1.

The members 6 and 7 are connected by two blocks 8 of resilient material, as for example a suitable sponge-like plastic of the type used in artificial sponges and the like, with the abutting portions of the members 6 and 7 and blocks 8 being suitably secured to one another, for example adhesively, forming a unitary structure in which the two members 6 and 7 may be moved toward one another by the application of suitable force thereon compressing the blocks 8. The canister 1 is adapted to be inserted in the recess 9 defined by the members 6, 7 and blocks 8, as illustrated in FIGS. 1 and 2, and the canister may be aligned in the recess 9 by means of suitable guide blocks 10 secured to the member 6 and preferably likewise formed of a deformable material as, for example the same material as that employed in the blocks 8 whereby the guide members may give as the canister is compressed. The width of the members 6 and 7, in the direction of the axis of the canister 1, is such that the end portions of the canister may extend outwardly beyond the adjacent end edges of the members 6 and 7, a distance sufficient to insure that deformation of the canister will be limited to the central portion of the canister whereby the end portions thereof will not be damaged.

The structure illustrated in FIG. 1 is fired by placing the member 6 on a floor or other supporting surface and applying downward force to the member 7, preferably with both hands, each disposed adjacent the ends of the member 7. Such downward movement should be a relatively sharp movement as distinguished from a slow steady movement to produce a rapid build-up of air pressure within the canister 1, readily elevating such pressure to a point where it will force off the cover member 5, resulting in an explosive-like noise-producing "bang". As illustrated in FIG. 3, the internal corners of the members 6 and 7 at the recess 9 may be rounded as indicated at 11 to prevent a localized creasing and sharp deformation that might cut or tear the body side wall.

FIG. 4 illustrates a container or canister structure which is very efficient for the intended purposes. The construction illustrated comprises, what may be considered, a laminated body 3 consisting of a central lamination 12 of cardboard or other suitable material to the inner face of which is secured an inner layer 13 of metal foil, such as aluminum foil, and to the outer face of which is secured an outer cover sheet 14 of paper, plasticised paper or the like. The closure member 4 is provided with an outwardly extending peripheral rim portion 15 of generally U-shaped configuration, in transverse cross-section, in which is received the adjacent end edge portion of the body 3, with the outer portion of the U-shaped rim being deformed or crimped onto the outer surface of the tubular body 3. The opposite end edge of the body 3 is provided with a metal rim portion 16 which is substantially of identical construction to the rim portion 15, and likewise is crimped onto adjacent end edge of the body member. However, in this case no closure member comparable to the member 4 is employed. Instead, the reinforced open end of the container thus formed is adapted to be sealed by a suitable closure member, such as the cover member 5 which is illustrated as being constructed of plastic or the like and provided with a peripheral lip or flange 17 which is adapted to be sprung over the outer edge of the rim member 16. Thus, the container or canister 1 may be sealed substantially air-tight.

To fire the device, the canister 1 is inserted into the recess 9 of the firing device 2 with the opposite ends of the canister extending outwardly approximately an equal distance beyond the firing device.

With the cover member 5 securely mounted on the end of the canister, the bottom member 6 of the device may be placed upon a suitable supporting surface, such as a floor or table, etc., and by placing the palms of the hands on the top surface of the upper member 7 adjacent each end thereof, adjacent a corresponding block 8, and applying a sharp downward force on the member 7, the central portion of the canister 1 may be collapsed resulting in a rapid build-up of air pressure within the canister to a point sufficient to pop off the cover member 5 resulting in a loud explosive-like noise. During the collapsing action the soft guide members 10 may give, whereby they will not affect such action.

The embodiment of the invention described is adapted to employ a canister 8½ inches long by 3 inches in diameter. As a result, a relatively large volume of air is trapped within the canister and upon compression of the air therein, and discharge of the cover member, a relatively deep or low pitched "bang" is produced, as compared with that of the usual pop-gun toy employing a cork of around ½ to ¾ of an inch in diameter.

It has been found that canisters, constructed in a manner similar to that illustrated in FIG. 4, employed in the commercial packaging of items, as for example food, satisfactorily perform when utilized in a firing device 2 as illustrated in FIG. 1. An example of a canister of this type is that employed in the packaging of manufactured potato chips. In such case the canister is closed at each end by a metal closure member constructed similar to the closure member 4 but provided, approximately at the juncture of the rim portion 15 with the disc-like central portion of the closure member, with a score line or the like. The central portion is then provided with a lift-up ring or other suitable means by which outwardly directed force may be applied to the central portion of the closure member to effect a tearing thereof on the score line and removal of the central portion, leaving just the rim portion thereof corresponding to the rim 16. In addition, such type of canister is usually packaged with a plastic closure member, corresponding generally to the cover member 5, for resealing the canister and any contents remaining therein.

FIGS. 5–7 illustrate a modified construction of the firing device 2. In this embodiment the base jaw member 6 and upper jaw member 7 are of generally oval construction, having rounded ends, with the lower or base member 6 having considerably greater height than the thickness of the member 7. Extending downwardly from the member 7 are two guide columns 18, respectively illustrated as being of cylindrical configuration, with the upper ends of the columns being rigidly secured to the member 7 and the lower ends slidably carried in bores 19 formed in the bottom member 6. In the embodiment illustrated, the bottom member 6 is shown in the form of a molded plastic structure or the like, of relatively thin wall construction and, in like manner, the member 7 and associated guide columns 18 likewise may be of plastic construction.

The member 7 is biased in an elevated position, such as illustrated in FIGS. 5 and 7, by respective coiled compression springs 20 which encircle the associated columns 18, bearing at their upper ends on the lower face of the member 7, and at their bottom ends on the upper face of the member 6. As illustrated in FIG. 5, guide blocks 10 of the compressible material, such as sponge rubber may be disposed on the upper surface of the member 6, for aligning the canister 1 in operative position, as previously described.

Operation of the embodiment illustrated in FIGS. 5–7 is the same as that previously described with respect to the construction of FIGS. 1–3. The canister 1 is inserted in the firing device, as illustrated in the drawings, with the blocks 10 maintaining the canister centered between the columns 18, and the central portion of the canister is then collapsed, as generally indicated in dotted lines in FIG. 7, by the application of downwardly directed force to the upper member 7. As in the construction illustrated in FIGS. 1–3, the lower corners of the member 7 and upper corners of the member 6, engageable with the canister, as it collapses, are rounded, as indicated at 11, to prevent a sharp creasing of and damage to the canister body. It will be noted that the height of the lower member 6 in the construction of FIGS. 5–7, and the length of the guide columns 18 are so proportioned that when the lower end of the columns 18 reach the supporting surface on which the member 6 rests, the lower end portions of the columns function as stops to limit the downward movement of the member 7, thus controlling the amount of deformation of the central portion of the canister. The springs 20, likewise may be so proportioned, as to length, when compressed, that they will function as stops.

As in the construction illustrated in FIGS. 1–3, the proportions of the members 6 and 7, i.e. the width thereof in the axial direction of the canister is so selected that the canister is collapsed and flattened over substantially as great an area as possible without producing any deformation in the end portions of the canister, i.e. at the closure member 4 or the rim member 16. As a result, the canister may be readily straightened out or returned to substantially its original condition and the cover member 5 reapplied to ready the canister for a subsequent firing operation.

FIGS. 5–7 also illustrate the use of a retaining member for connecting the cover member 5 with the body 3 of the canister. Such retaining means in the embodiment illustrated comprises a strip of tape 23, for example a plastic tape such as so-called "electrician's tape" or a resilient band of rubber or the like. The strip 23 is of suitable length to extend across the outer face of the cover member 5, as clearly illustrated in FIG. 5, and the free end portions 24 of the tape are secured to the outer periphery of the body 3. As clearly illustrated in FIG. 7, an outwardly directed loop 25 is formed in the tape at each end thereof adjacent its connection to the body 3, with the inner surface of such loop either being without adhesive coating or having a covering strip applied thereto which covers any exposed adhesive thereon. The length of the portions of the strip comprising the loops 25 is such as to permit the cover 5 to be separated from the adjacent end of the body member 3 sufficiently to enable the production of the desired noise and yet restrict further movement of the cover member. The latter thus is retained with the body member, preventing loss, and at the same time disposes the cover member for easy reassembly with the canister body 3.

It will be particularly noted that the various constructions illustrated and described are exceedingly simple in construction, and at the same time are substantially foolproof in operation, with no danger of injury to the user. Likewise, the proportions of the canister employed and of the firing device are such that a person, particularly a child, cannot be injured with the device. Further, the device employs no explosive or other materials, relying solely upon air pressure for its actuation.

Where available, commercial packaging canisters and the like, of suitable dimensions, provide an ample supply of canisters for replacement purposes. However, as previously mentioned a canister constructed in the manner described has exceptional durability and is capable of being compressed many times, perhaps hundred of times before losing air tightness. Further, a canister construction such as described tends to improve with use, the central portion of the canister becoming more pliable and deformable with use, while at the same time the rigid characteristics are retained adjacent the two ends of the canister thereby eliminating possible deformation of and damage to the end portions of the canister, which would preclude its further use.

It will also be appreciated that in the construction of FIG. 5, the springs 20 also may serve a limiting function with respect to the downward movement of the member 7 relative to the member 6.

Although I have described my invention by reference to particular illustrative embodiments, many changes and modifications of the invention may become apparent to those skilled in the art without departing from the spirit and scope of the invention. I therefore intend to include within the patent warranted hereon all such changes and modifications as may reasonably and properly be included within the scope of my contribution to the art.

I claim as my invention:

1. A pneumatic noise-producing toy comprising a hollow cylindrical container having an elongated deformable tubular body member, closed at one end and provided with a removable closure member at the other end, a firing device cooperable with said container, having a pair of spaced jaw members, between which the container may be disposed, for applying compression forces to the intermediate portion of said body member to deform the latter and compress said body member to increase the air pressure therein sufficiently to forcibly disengage the closure member therefrom with the simultaneous production of an explosion-like noise, and means associated with said jaw members for guiding the latter during movement thereof toward and away from one another, wherein said guide means comprises a pair of blocks of resilient material extending between and secured to the respective jaw members, forming guiding means therefor with the inherent resiliency of the blocks being operative to return the jaw members to initial positions spaced apart sufficiently to permit insertion of said container therebetween.

2. A noise producing toy according to claim 1, comprising in further combination, resilient means for facilitating aligning of the container between the jaw members.

3. A noise producing toy according to claim 2, wherein said aligning means comprises resilient blocks of material carried by said lower jaw member and extending in the same direction as the axis of said container.

4. A noise-producing toy according to claim 1, comprising in further combination, means connected to said container and removable closure member, wherein said means connecting said container and closure member comprises at least one strip of flexible material connected at its respective ends to the container and closure member, and of a length to permit the desired disengagement therebetween sufficient to enable the production of the desired noise and yet restrict further movement of the cover member.

5. A toy firing device, for applying pressure to a hollow deformable container to increase the air pressure therein sufficiently to forcibly disengage a closure member from said container, and produce an explosion-like noise, comprising a pair of relatively moveable jaw members disposed in spaced relation, with the operative distance therebetween being sufficient to receive the intermediate portion of such a container therebetween, means for guiding said jaw members for movement toward and away from one another, wherein said guide means comprises a pair of blocks of resilient material extending between and secured to the respective jaw members, forming guiding means therefor with the inherent resiliency of the blocks being operative to return the jaw members to initial positions spaced apart sufficiently to permit insertion of such a container therebetween, said jaw members being moveable toward one another a distance sufficient to deform the intermediate portion of a container disposed therebetween whereby the air therein is compressed sufficiently to disengage such a closure member therefrom.

6. A toy device according to claim 5, comprising in further combination, resilient means for facilitating aligning of the container between the jaw members.

7. A toy device according to claim 6, wherein said aligning means comprises a pair of laterally spaced elongated resilient blocks of material carried by said lower jaw member and disposed in parallel relation, said blocks being engageable with such a container disposed between the jaw members for aligning the axis of such a container in parallel relation with respect to said blocks.

8. In a pneumatic noise producing device, the combination of a hollow generally cylindrical container, closed at one end and open at the other end, said container having a deformable exterior wall, and means for selectively collapsing said wall comprising upper and lower spaced jaw members joined by continuous biasing means and actuatable against the biasing means to selectively deform the wall, a removable closure member, adapted to seat firmly on said open end of the container whereby, upon partial collapsing of the latter, sufficient air pressure will be built up in the container to force the closure member out of engagement with the container member with the simultaneous production of an explosion-like noise, and means, connected to said container and removable closure member, arranged to permit disengagement of said closure member from the container, while providing a connecting tie therebetween to prevent loss when so disengaged.

9. A noise producing device according to claim 8, wherein said means connecting said container and closure member comprises at least one strip of flexible material connected at its respective ends to the container and closure member, and of a length to permit the desired disengagement therebetween.

10. A noise producing device according to claim 8, wherein in said means connecting said container and closure member comprises a strip of resilient material connected at its respective ends to the container.

* * * * *